US009728309B2

(12) United States Patent
Wang et al.

(10) Patent No.: US 9,728,309 B2
(45) Date of Patent: Aug. 8, 2017

(54) VARIABLE RESISTANCE AND MANUFACTURING METHOD THEREOF

(71) Applicant: BOE TECHNOLOGY GROUP CO., LTD., Beijing (CN)

(72) Inventors: Hong Wang, Beijing (CN); Tianyue Zhao, Beijing (CN); Yanling Han, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 196 days.

(21) Appl. No.: 14/375,908

(22) PCT Filed: Sep. 22, 2013

(86) PCT No.: PCT/CN2013/083914

§ 371 (c)(1),
(2) Date: Jul. 31, 2014

(87) PCT Pub. No.: WO2014/187051

PCT Pub. Date: Nov. 27, 2014

(65) Prior Publication Data

US 2015/0340135 A1 Nov. 26, 2015

(30) Foreign Application Priority Data

May 21, 2013 (CN) ..... 2013 1 0190119

(51) Int. Cl.
*H01C 10/12* (2006.01)
*H01C 10/10* (2006.01)
(Continued)

(52) U.S. Cl.
CPC ..... *H01C 10/106* (2013.01); *H01C 17/02* (2013.01); *H01C 17/28* (2013.01); *H01C 1/02* (2013.01);
(Continued)

(58) Field of Classification Search
CPC ..... H01C 10/106; H01C 17/02; H01C 17/28; H01C 1/02
(Continued)

(56) References Cited

U.S. PATENT DOCUMENTS 3,629,774 A * 12/1971 Crites ..... H01C 10/106 219/528
3,787,718 A * 1/1974 Patterson ..... H01C 7/00 257/417
(Continued)

FOREIGN PATENT DOCUMENTS

CN 101341557 A 1/2009
CN 201765868 U 3/2011
(Continued)

OTHER PUBLICATIONS

CN201020260776 machine translation, Jul. 2010.*
(Continued)

*Primary Examiner* — Kyung Lee
(74) *Attorney, Agent, or Firm* — Collard & Roe, P.C.

(57) ABSTRACT

Embodiments of the present disclosure disclose a variable resistance and a manufacturing method thereof, and the variable resistance is a variable resistance with continually adjustable resistance value. This variable resistance comprises: an elastic insulation envelope and conductive particles filled in the elastic insulation envelope. The manufacturing method of the variable resistance comprises: filling conductive particles into an elastic insulation envelope with an opening; and sealing the opening of the elastic insulation envelope.

20 Claims, 1 Drawing Sheet

(51) Int. Cl.
*H01C 17/28* (2006.01)
*H01C 17/02* (2006.01)
*H01C 1/02* (2006.01)

(52) U.S. Cl.
CPC .... *Y10T 29/49089* (2015.01); *Y10T 29/49099* (2015.01)

(58) Field of Classification Search
USPC ..... 338/114; 29/613, 619
See application file for complete search history.

(56) References Cited

U.S. PATENT DOCUMENTS 4,098,945 A * 7/1978 Oehmke ..... C09D 5/24 252/500
5,068,634 A * 11/1991 Shrier ..... H01B 1/14 252/512
5,168,313 A * 12/1992 Hosaka ..... G03G 15/1685 399/313
5,536,568 A * 7/1996 Teruo ..... C08L 83/04 252/502
5,858,533 A 1/1999 Greuter et al.
6,714,117 B2 * 3/2004 Sandbach ..... G06F 3/045 114/210
7,843,308 B2 * 11/2010 Pachla ..... H01C 7/12 252/301.4 R
8,362,871 B2 * 1/2013 Kosowsky ..... H01C 7/12 338/13
9,208,931 B2 * 12/2015 Kosowsky ..... H05K 1/0257
2009/0139754 A1 6/2009 Ikarashi et al.

FOREIGN PATENT DOCUMENTS

EP 0 649 150 A1 4/1995
JP 10-199704 A 7/1998

OTHER PUBLICATIONS

JP1997-017364 machine translation, Jan. 1997.*
Chinese Office Action of Chinese Application No. 201310190119.5, mailed Jun. 26, 2015 with English translation.
English translation of the International Preliminary Report on Patentability and Written Opinion of the International Searching Authority of PCT/CN2013/083914, issued Nov. 24, 2015.
English Translation of the International Search Report of PCT/CN2013/083914 published in English on Nov. 27, 2014.
International Search Report, International Preliminary Report on Patentability and Written Opinion of the International Searching Authority of PCT/CN2013/083914 in Chinese, mailed Feb. 27, 2014.

* cited by examiner

VARIABLE RESISTANCE AND MANUFACTURING METHOD THEREOF

CROSS REFERENCE TO RELATED APPLICATIONS

This application is the National Stage of PCT/CN2013/083914 filed on Sep. 22, 2013, which claims priority under 35 U.S.C. §119 of Chinese Application No. 201310190119.5 filed on May 21, 2013, the disclosure of which is incorporated by reference.

TECHNICAL FIELD

Embodiments of the present disclosure relate to a variable resistance and a manufacturing method thereof.

BACKGROUND

Variable resistances are common circuit elements with adjustable resistance value and hence a current in the circuit can be changed. And at the same time, it can change the distribution of voltages in a circuit can also be changed so as to limit current and protect elements in the circuit.

However, there is no variable resistance, resistance value of which can be adjusted continuously and has a simple structure at present.

SUMMARY

The technical problem to be addressed by embodiments of the present disclosure is to provide a variable resistance with continuously adjustable resistance value and with a simple structure and a method for manufacturing the variable resistance.

Embodiments of the present disclosure provide a technical solution as follows to address the above mentioned technical problems.

According to one aspect of the present disclosure provides a variable resistance comprising an elastic insulation envelope and conductive particles filled in the elastic insulation envelope.

The variable resistance further comprises insulating particles mixed with conductive particles proportionally to together fill up the elastic insulation envelope.

The conductive particles are insulating particles coated with conductor coatings.

The elastic insulation envelope is of tubular structure.

The variable resistance further comprises:

insulating plugs inserted into two ends of the elastic insulation envelope;

wiring posts extending through the insulating plugs, one end of the wiring post contacting conductive particles in the elastic insulation envelope and the other end of the wiring post extending beyond the insulating plug.

The insulating plug has a support section and a plugging section, the support section has a cross-section greater than that of the plugging section, and the plugging section fits into one end of the elastic insulation envelope.

The insulating particles are made of insulating resin.

An embodiment of the present disclosure provides a variable resistance comprising an elastic insulation envelope and conductive particles filled in the elastic insulation envelope. As the weight and volume of conductive particles filled in the elastic insulation envelope are constant, the resistance value of the variable resistance only depends on the length of the elastic insulation envelope. While the length of the elastic insulation envelope is continuously adjustable, thus the resistance value of the variable resistance is also continuously adjustable. The variable resistance has a simple structure such that the variable resistance can be easily manufactured, used and stored.

Another aspect of the present disclosure provides a manufacturing method for a variable resistance, the method comprising:

a step of filling conductive particles into an elastic insulation envelope with openings;

a step of sealing openings of the elastic insulation envelope.

Before the step of filling conductive particles into the elastic insulation envelope with openings, the method further comprises:

piercing a wiring post into and making the wiring post extend through the insulating plug;

inserting the insulating plug with the wiring post into one end of the elastic insulation envelope.

Filling conductive particles into the elastic insulation envelope comprises:

filling conductive particles and insulating particles mixed in proportion into the elastic insulation envelope with one end inserted with the insulating plug.

The sealing openings of the elastic insulation envelope comprises: inserting an insulating plug into the other end of the elastic insulation envelope; piercing a wiring post into the insulating plug at the other end of the elastic insulation envelope.

The elastic insulation envelope is of tubular structure.

The conductive particles are insulating particles coated with conductor coatings, and the insulating particles may be made of insulating resin.

The technical solution according to embodiments of the present disclosure provides a method for manufacturing a variable resistance which is simple and straightforward and can be carried out at a low cost, and the variable resistance manufactured can realize continuous adjustment of resistance value and are easy to be used and stored.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiment will be described in a clearly and fully understandable way in connection with the drawings related to the embodiments of the disclosure. It is obvious that the described embodiments are just a part but not all of the embodiments of the disclosure. Based on the described embodiments herein, those skilled in the art can obtain other embodiment(s), without any inventive work, which should be within the scope of the disclosure.

Figure 1:
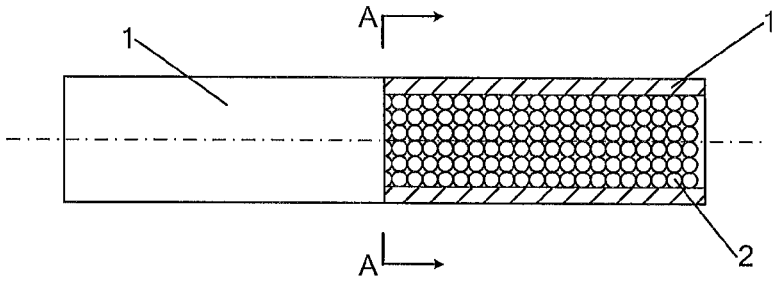
FIG. 1 is a schematic structure view of a variable resistance according to an embodiment of the present disclosure.
Figure 2:
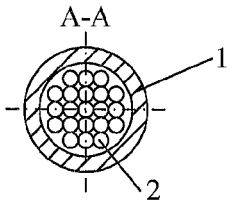
FIG. 2 is a A-A schematic cross-sectional view of FIG. 1.

An embodiment of the present disclosure provides a variable resistance as illustrated in FIGS. 1 and 2, comprising an elastic insulation envelope 1 and conductive particles 2 filled in the elastic insulation envelope 1. The term "variable resistance" is different form a traditional slide rheostat which has a ceramic cylinder and resistance wire wound on the ceramic cylinder and the minimum adjustable resistance value of which is the resistance value of one turn of the resistance wire. The variable resistance has a continuous adjustable resistance value.

It is well known that a resistance value R of a resistor element is typically related to its temperature and the length, the cross-sectional area and the material of which the conductor is made. When the temperature does not change too much, the resistance value can be expressed as:

$$R = \rho\frac{L}{S} \tag{1}$$

Wherein ρ is the resistivity depending on the material; L is the length of conductor; S is the cross section area of the conductor.

It should be noted that in order to represent conductive particles 2 filled in the elastic insulation envelope 1, conductive particles 2 are illustrated in an exaggerative manner in FIGS. 1 and 2. In fact, these conductive particles 2 generally have sizes of nanometer order. And as conductive particles 2 are solid particles, after filling into the elastic insulation envelope 1, the total number of conductive particles 2 in a unit volume and distance between conductive particles 2 are substantially constant. Therefore, the distribution of conductive particles 2 everywhere inside the elastic insulation envelope 1 is almost uniform and stable, that is, the resistivity ρ at everywhere in the elastic insulation envelope 1 are approximately identical.

When an external force is applied to the elastic insulation envelope 1 along a direction of the axis, the length of the elastic insulation envelope 1 varies, and accordingly its cross-sectional area changes, but the volume of the elastic insulation envelope 1 keeps unchanged, and the internal volume thereof is not changed either. Due to the constant quality and constant volume of conductive particles 2 filled in the elastic insulation envelope 1, given a constant volume of the elastic insulation envelope 1, the concentration degree of conductive particles 2 is almost constant. Therefore, regardless of the variation of the form of the elastic insulation envelope 1, resistivities ρ at everywhere inside it are almost constant and identical.

Furthermore, expression (1) can be further expressed as:

$$R = \rho\frac{L}{S} = \rho\frac{L\times L}{S\times L} = \rho\frac{L^2}{V} \tag{2}$$

In the equation (2), V is the total volume of conductive particles 2 filled in the elastic insulation envelope 1. As can be known from the above description, the volume of conductive particles 2 filled in the elastic insulation envelope 1 is constant. Therefore, the resistance value of the variable resistance is dependent on only the square of the length of elastic insulation envelope 1 in a direct proportion relationship. While the length of the elastic insulation envelope 1 can be continuously adjusted, hence the resistance value of the variable resistance can also be continuously adjusted, and as the resistance value of the variable resistance is only in direct proportion to the square of length of the elastic insulation envelope 1, the resistance value of the variable resistance is highly sensitive to the length of the elastic insulation envelope 1, and is easily adjustable.

It should be understood that the solid material comprising conductive particles 2 filled in the elastic insulation envelope 1 has a spatial ductility or a spatial extrudability when the elastic insulation envelope 1 is extended or extruded. For example, there are gap clearances among spherical conductive particles 2, or conductive particles 2 can be of certain elasticity, or proper spaces are reserved when conductive particles 2 are filled into the elastic insulation envelope 1, so long as electrical conductivity among conductive particles 2 is not influenced.

As for the variable resistance according to embodiments of the present disclosure, it is possible to continuously change the resistance value of the variable resistance by simply stretching or compressing the elastic insulation envelope, and in turn design a range in which the resistance value of the variable resistance changes. Compared to slide rheostats in conventional arts, components such as resistance wire wound on an insulating ceramic cylinder and the slide blade are not required any longer; and the adjusting mode of traditional slide rheostats in which resistance value can not be continuously adjusted is modified (generally, the minimum adjustable resistance value for a traditional slide rheostat is the resistance value of one turn of the resistance wire).

At the same time, the variable resistance has a simple structure. On the basis of the above mentioned structure, both ends of the elastic insulation envelope 1 are sealed by any known sealing approach, and a wiring post is drawn out at each end of the elastic insulation envelope 1, then it may be brought into service. And due to its simple structure, the variable resistance is convenient for storage.

Generally, the elastic insulation envelope 1 is made of an insulating material with good elasticity, such as rubber. Further, in order to facilitate manufacturing the elastic insulation envelope and fill conductive particles 2, the elastic insulation envelope 1 can be selected as a cylinder structure.

It should be noted that, although the elastic insulation envelope 1 is illustrated as a cylinder shape in FIGS. 1 and 2, the elastic insulation envelope 1 can be of arbitrary shapes, which is not limited in embodiments of the present disclosure.

Another aspect of the present disclosure provides a method for sealing the elastic insulation envelope 1. The method is only illustrative rather than limiting the method for sealing the elastic insulation envelope 1.

Figure 3A:
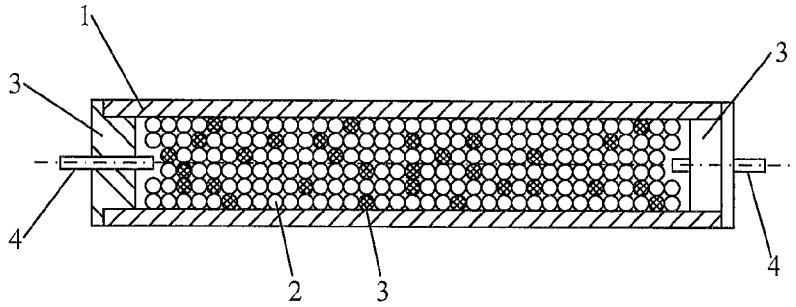
FIGS. 3*a*~3*b* is another schematic structure view of the variable resistance according to an embodiment of the present disclosure.
Figure 3B:
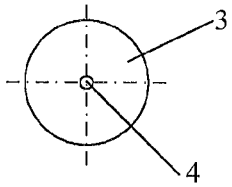

In an embodiment of the present disclosure, as illustrated in FIGS. 3*a* and 3*b*, the variable resistance further comprises:

Insulating plugs 3 inserted into the two ends of the elastic insulation envelope 1;

wiring posts 4, each extending through the insulating plugs 3, with one end contacting with conductive particles 2 filled in the elastic insulation envelope 1, and the other end extending beyond the insulating plug 3.

Figure 4:
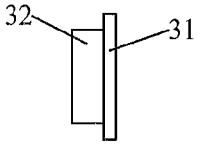
FIG. 4 is a schematic structure view of an insulating plug according to an embodiment of the present disclosure.

The insulating plug 3 as illustrated in FIG. 4 has a support section 31 and a plugging section 32. The support section 31 has a size of cross-section greater than that of the plugging section 32. The plugging section 32 fits the elastic insulation envelope 1.

For example, the plugging section 32 is made of an elastic material such as plastic cement. The plugging section 32 is inserted into the elastic insulation envelope 1 so as to seal both ends of the elastic insulation envelope 1. Generally, it is also possible to enhance the fitting degree between the plugging section 32 and the elastic insulation envelope 1 by connection approaches such as welding. The support section 31 has a size of cross-section greater than that of the plugging section 32 to prevent the entire insulating plug 3 from being inserted into the elastic insulation envelope 1 due to inappropriate installation, hence enhancing the fitting degree of the insulating plug 3 and the elastic insulation envelope 1.

After mounting the insulating plug 3 into the elastic insulation envelope 1, the wiring post 4 is fitted into the insulating plug 3 by being pierced into the insulating plug 3. Furthermore, as can be known from FIGS. 3*a* and 3*b*, one end of the wiring post 4 must contact with conductive particles 2 in the elastic insulation envelope 1, and the other end extends beyond the insulating plug 3 to hang up outside the insulating plug 3, providing the wiring function. Of course, it is also possible to provide a preformed hole in the insulating plug 3 to realize fitting between the wiring post 4 and the insulating plug 3.

It should be noted that the insulating plugs 3 illustrated in FIGS. 3*a* and 3*b* are only illustrative. In practice, any structure that can seal the elastic insulation envelope 1 can be used, for example, the insulating plug 3 may be a revolving body with a trapezoid axial cross section.

Furthermore, when particles filled in the elastic insulation envelope 1 are all conductive particles 2, the range of its resistance value is small no matter how to change the form of the variable resistance, which is not ideal. Therefore, for example, as illustrated in FIG. 3*a* or 3*b*, the variable resistance further comprises insulating particles 5. The insulating particles 5 and the conductive particles 2 are mixed in a certain proportion to fill up together in the elastic insulation envelope 1, so as to obtain resistive particles with a sufficient resistivity ρ and satisfying operation requirements, and in turn obtain a variable resistance with ideal range of resistance value. The proportion may be set according to the requirements on the range of resistance value of the variable resistance, so long as the insulating particles 5 will not influence the conducting function of the conductive particles 2. The mass ratio of the insulating particles 5 to the conductive particles 2 ranges from 1:4 to 1:1, for example, 1:4, 1:3, 1:2 or 1:1. The mass ratio may be other values, which will not be enumerated one by one here.

When all particles filled in the elastic insulation envelope 1 are conductive particles, the range of resistance value of the variable resistance is small, it is possible for the variable resistance to be used as an elasticity wire.

In order to reduce the weight of the variable resistance, the insulating particles 5 may be made of insulating resin, such as poly-tetrafluoro ethylene resin, poly-perfluoroethylene resin, and epoxy resin. Conductive particles 2 can be particles made of conductor materials such as metals. The conductive particles 2 can also be insulating particles coated with conductor coatings to further reduce the weight of the variable resistance, for example, insulating particles 5 coated with conductor coatings. Coating conductor material such as metal on the insulating particles 5 can be implemented by powder technology.

An embodiment of the present disclosure provides a variable resistance comprising an elastic insulation envelope and conductive particles filled in the elastic insulation envelope. Conductive particles with constant quality and constant volume are filled in the elastic insulation envelope such that the resistance value of the variable resistance only depends on the length of the elastic insulation envelope. It is possible for the variable resistance according to embodiments of the present disclosure to change resistance value of the variable resistance by simply stretching or compressing the length of the elastic insulation envelope, without changing the resistance value by changing the contact between the resistance wire and the slide blade. And the length of the elastic insulation envelope may vary continuously, and the resistance value of the variable resistance can also vary continuously. At the same time, the variable resistance has a simple structure that facilitates production, use and storage of the variable resistance.

Furthermore, an embodiment of the present disclosure further provides a method for manufacturing the variable resistance illustrated in FIG. 1, comprising steps as following:

Step S101, filling conductive particles into an elastic insulation envelope with an opening;

Step S102, sealing the opening of the elastic insulation envelope.

In order to obtain the variable resistance illustrated in FIG. 3*a*, it further comprises steps as following before step S101:

Step S201, piercing a wiring post into an insulating plug, with the wiring post extending through the insulating plug;

Step S202, inserting the insulating plug with the wiring post into one end of the elastic insulation envelope;

Based on step S202, step S101 further comprises:

Step S203, filling conductive particles and insulating particles mixed in proportion into the elastic insulation envelope with one end inserted with the insulating plug.

Step S102 can further comprise:

Step S204, inserting an insulating plug into the other end of the elastic insulation envelope;

Step S205, piercing a wiring post into the insulating plug at the other end of the elastic insulation envelope.

For example, the elastic insulation envelope 1 has a cylinder structure. The conductive particles 2 can be insulating particles 5 coated with conductor coatings. The material of the insulating particles 5 may be insulating resin such as poly-tetrafluoro ethylene resin, poly-perfluoroethylene, epoxy resin and the like.

An embodiment of the present disclosure provides a method for manufacturing variable resistances which is simple and straightforward and can be carried out at a low cost, and the variable resistances manufactured can realize continuous variation of resistance value and are easy to be used and stored.

The foregoing are merely exemplary embodiments of the invention, but are not used to limit the protection scope of the invention. The protection scope of the invention shall be defined by the attached claims.

The invention claimed is:

1. A variable resistance comprising:

an elastic insulation envelope; and conductive particles filled in the elastic insulation envelope;

wherein the conductive particles are in electrical connection with each other.

2. The variable resistance according to claim 1, further comprising:

first insulating particles mixed with the conductive particles in proportion, the first insulating particles and the conductive particles filled in the elastic insulation envelope together.

3. The variable resistance according to claim 1, wherein the conductive particles are second insulating particles coated with conductor coatings.

4. The variable resistance of claim 2, wherein a weight ratio of the insulating particles (5) to the conductive particles (2) ranges from 4:1 to 1:1.

5. The variable resistance according to claim 2, wherein the conductive particles are second insulating particles coated with conductor coatings.

6. The variable resistance according to claim 2, wherein the elastic insulation envelope has a cylinder structure.

7. The variable resistance according to claim 2, further comprising:

an insulating plug inserted partially into each end of the elastic insulation envelope; and a wiring post extending through the insulating plug, one end of each wiring post contacting the conductive particles filled in the elastic insulation envelope, and the other end of the wiring post extending beyond the insulating plug.

8. The variable resistance according to claim 3, wherein both the first insulating particles and the second insulating particles are made of an insulating resin.

9. The variable resistance according to claim 3, wherein both the first insulating particles and the second insulating particles are made of an insulating resin.

10. The variable resistance according to claim 3, further comprising:

an insulating plug inserted partially into each end of the elastic insulation envelope; and a wiring post extending through the insulating plug, one end of each wiring post contacting the conductive particles filled in the elastic insulation envelope, and the other end of the wiring post extending beyond the insulating plug.

11. The variable resistance according to claim 1, wherein the elastic insulation envelope has a cylinder structure.

12. The variable resistance according to claim 1, further comprising:

an insulating plug inserted partially into each end of the elastic insulation envelope; and a wiring post extending through the insulating plug, one end of each wiring post contacting the conductive particles filled in the elastic insulation envelope, and the other end of the wiring post extending beyond the insulating plug.

13. The variable resistance according claim 12, wherein the insulating plug has a supporting section and a plugging section, a size of cross-section of the supporting section is greater than that of the plugging section, and the plugging section fits into the elastic insulation envelope.

14. A method for manufacturing a variable resistance, comprising:

filling conductive particles into an elastic insulation envelope with an opening; and sealing the opening of the elastic insulation envelope.

15. The method according to claim 14, wherein before the filling conductive particles into the elastic insulation envelope, the method further comprises:

piercing a wiring post into and making the wiring post extend through an insulating plug; and inserting the insulating plug with the wiring post into one end of the elastic insulation envelope.

16. The method according to claim 15, wherein the sealing openings of the elastic insulation envelope comprises:

inserting an insulating plug into the other end of the elastic insulation envelope;

piercing an wiring post into the insulating plug at the other end of the elastic insulation envelope.

17. The method according to claim 15, wherein the filling the conductive particles into the elastic insulation envelope comprises:

filling conductive particles and first insulating particles mixed in proportion into the elastic insulation envelope with one end inserted with the insulating plug.

18. The method according to claim 17, wherein the conductive particles are second insulating particles coated with conductor coatings, and the first insulating particles and the second insulating particles are made of an insulating resin.

19. The method according to claim 17, wherein a weight ratio of the insulating particles (5) to the conductive particles (2) ranges from 4:1 to 1:1.

20. The method according to claim 14, wherein the elastic insulation envelope has a cylinder structure.

* * * * *